US010548440B2

(12) United States Patent
Gammack et al.

(10) Patent No.: US 10,548,440 B2
(45) Date of Patent: Feb. 4, 2020

(54) HAND DRYER

(71) Applicant: Dyson Technology Limited, Wiltshire (GB)

(72) Inventors: Peter David Gammack, Gloucester (GB); Stephen Benjamin Courtney, Bath (GB); Leigh Michael Ryan, Melbourne (AU); Stuart James Steele, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 15/632,168

(22) Filed: Jun. 23, 2017

(65) Prior Publication Data

US 2017/0280948 A1 Oct. 5, 2017

Related U.S. Application Data

(62) Division of application No. 13/850,923, filed on Mar. 26, 2013.

(30) Foreign Application Priority Data

Mar. 26, 2012 (GB) ..... 1205263.5

(51) Int. Cl.

| | |
|---|---|
| ***A47K 10/48*** | (2006.01) |
| ***F26B 21/00*** | (2006.01) |
| ***F26B 25/06*** | (2006.01) |

(52) U.S. Cl.

CPC ..... *A47K 10/48* (2013.01); *F26B 21/004* (2013.01); *F26B 25/06* (2013.01)

(58) Field of Classification Search

CPC ..... A47K 10/48; A47K 10/00; F26B 21/004; F26B 25/06; A45D 20/16

(Continued)

(56) References Cited

U.S. PATENT DOCUMENTS

| | | | |
|---|---|---|---|
| 1,997,387 | A | 4/1935 | McCord |
| 4,785,162 | A | 11/1988 | Kuo |

(Continued)

FOREIGN PATENT DOCUMENTS

| | | |
|---|---|---|
| CH | 379 717 | 7/1964 |
| CN | 102665512 | 9/2012 |

(Continued)

OTHER PUBLICATIONS

Bobrick Technical Data, TrimLine Surface-Mounted ADA Dryer, B-7120, B-7128, Apr. 27, 2011.*

(Continued)

*Primary Examiner* — Edelmira Bosques
*Assistant Examiner* — Bao D Nguyen
(74) *Attorney, Agent, or Firm* — Morrison & Foerster LLP

(57) ABSTRACT

The invention relates to a wall-mountable hand dryer of the type which uses an air-knife to wipe the water from a user's hand. In accordance with the invention, the hand dryer is configured to have a maximum depth, front-to-back, of less than 150 mm when it is surface-mounted on—not recessed within—the wall. The air-knife is discharged downwardly through one or more discharge apertures on the dryer. These discharge apertures are configured so that the air-knife is discharged in front of the wall or a rear part of the dryer, and is discharged forwards towards the user at a downward angle. The downward angle of the air-knife is such that the air-knife projects to a distance of at least 75 mm in front of the wall or, as the case may be, in front of the rear part of the dryer.

4 Claims, 10 Drawing Sheets

(58) Field of Classification Search
USPC ..... 34/523
See application file for complete search history.

(56) References Cited

U.S. PATENT DOCUMENTS

| | | | | |
|---|---|---|---|---|
| 5,146,695 | A | 9/1992 | Yang | |
| 6,038,786 | A | 3/2000 | Aisenberg et al. | |
| 7,437,833 | B2 | 10/2008 | Sato et al. | |
| D599,059 | S | 8/2009 | Clerch | |
| 7,596,883 | B2 | 10/2009 | Kameishi | |
| 7,614,160 | B2 | 11/2009 | Kameishi et al. | |
| 7,971,368 | B2 | 7/2011 | Fukaya et al. | |
| 8,043,714 | B2 | 10/2011 | Hashimoto | |
| 8,136,262 | B2 | 3/2012 | Collins | |
| 8,347,522 | B2 | 1/2013 | Dyson et al. | |
| 8,607,472 | B2 | 12/2013 | Ishii et al. | |
| 2007/0144034 | A1* | 6/2007 | Kameishi | A47K 10/48 34/523 |
| 2008/0263889 | A1 | 10/2008 | Fukaya et al. | |
| 2008/0313918 | A1* | 12/2008 | Dyson | A47K 10/48 34/202 |
| 2009/0000140 | A1 | 1/2009 | Collins | |
| 2009/0044420 | A1 | 2/2009 | Hsu | |
| 2010/0192399 | A1 | 8/2010 | Sawabe et al. | |
| 2011/0277342 | A1 | 11/2011 | Ishii et al. | |
| 2012/0017460 | A1 | 1/2012 | Kikuchi et al. | |
| 2013/0042495 | A1 | 2/2013 | Ryan et al. | |
| 2013/0042496 | A1 | 2/2013 | Courtney et al. | |
| 2013/0042497 | A1 | 2/2013 | Ryan et al. | |
| 2013/0055588 | A1 | 3/2013 | Nakamura et al. | |
| 2013/0276328 | A1 | 10/2013 | Gammack et al. | |

FOREIGN PATENT DOCUMENTS

| | | |
|---|---|---|
| DE | 30 36 623 | 2/1982 |
| GB | 737054 | 9/1955 |
| GB | 909069 | 10/1962 |
| GB | 915674 | 1/1963 |
| GB | 2 428 569 | 2/2007 |
| GB | 2 428 570 | 2/2007 |
| GB | 2 450 561 | 12/2008 |
| GB | 2 450 563 | 12/2008 |
| JP | 61-179993 | 11/1986 |
| JP | 4-221523 | 8/1992 |
| JP | 9-56640 | 3/1997 |
| JP | 9-135788 | 5/1997 |
| JP | 10-113305 | 5/1998 |
| JP | 10-257992 | 9/1998 |
| JP | 11-283 | 1/1999 |
| JP | 2000-180 | 1/2000 |
| JP | 2000-157448 | 6/2000 |
| JP | 2000-184987 | 7/2000 |
| JP | 2002-136448 | 5/2002 |
| JP | 2004-215879 | 8/2004 |
| JP | 2007-98106 | 4/2007 |
| JP | 2007-143584 | 6/2007 |
| JP | 2008-5883 | 1/2008 |
| JP | 2008-272251 | 11/2008 |
| JP | 2009-502392 | 1/2009 |
| JP | 2013-22226 | 2/2013 |
| JP | 2013-39377 | 2/2013 |
| WO | WO-2009/011198 | 1/2009 |
| WO | WO-2010/088975 | 8/2010 |
| WO | WO-2010/095250 | 8/2010 |
| WO | WO-2010/095251 | 8/2010 |
| WO | WO-2011/077625 | 6/2011 |
| WO | WO-2013/024252 | 2/2013 |

OTHER PUBLICATIONS

Search Report dated Jul. 18, 2012, directed to GB Application No. 1205263.5; 2 pages.

International Search Report and Written Opinion dated Jan. 30, 2014, directed to International Application No. PCT/GB2013/050558; 12 pages.

Mediclinics Catalogue 2009-2010, "Speedflow (RTM) Hand dryers," on pp. 14-15 and Technical specifications on p. 15 located at <http://www.mediclinics.co.uk/downloads/mediclinicscatalogue20092010.pdf> accessed on Jul. 16, 2012. (69 pages).

World Dryer: Press Release (May 31, 2011) "SLIMdri: The Bantamweight that Packs a Punch," Berkeley, IL, located at <http://www.worlddryer.com/node/267> accessed on Jul. 16, 2012. (1 page).

World Dryer: SLIMdri Hand Dryer. Surface-Mounted ADA Compliant Hand Dryer brochure located at <http://www.worlddryer.com/sites/default/files/92_MT050_SLIMdri_sellsheet.pdf> accessed Jul. 16, 2012. (2 pages).

Bobrick: TrimLine Surface-Mounted ADA Dryer B-7120, B-7128 Technical data Sheet located at <http://www.bobrick.co.uk/media/uploads/products/B-7120,_71281.pdf> accessed Jul. 16, 2012. (4 pages).

Ryan et al., U.S. Office Action dated Jun. 16, 2014, directed to U.S. Appl. No. 13/587,422; 8 pages (20563.00).

Courtney et al., U.S. Office Action dated Sep. 11, 2014, directed to U.S. Appl. No. 13/587,453; 6 pages (20565.00).

Gammack et al., U.S. Office Action dated Oct. 28, 2015, directed to U.S. Appl. No. 13/850,889; 16 pages.

Gammack et al., U.S. Office Action dated Jun. 2, 2016, directed to U.S. Appl. No. 13/850,889; 16 pages.

Gammack et al., U.S. Office Action dated Oct. 29, 2015, directed to U.S. Appl. No. 13/850,923; 16 pages.

Gammack et al., U.S. Office Action dated Jun. 9, 2016, directed to U.S. Appl. No. 13/850,923; 16 pages.

Gammack et al., U.S. Office Action dated Dec. 23, 2016, directed to U.S. Appl. No. 13/850,923; 16 pages.

* cited by examiner

HAND DRYER

REFERENCE TO RELATED APPLICATIONS

This application is a divisional of U.S. patent application Ser. No. 13/850,923, filed Mar. 26, 2013, which claims the priority of United Kingdom Application No. 1205263.5 filed Mar. 26, 2012, the entire contents of which are incorporated herein by reference.

FIELD OF THE INVENTION

The present invention relates to a wall-mountable hand dryer of the type which uses an air-knife to wipe water from the surface of the user's hands.

BACKGROUND OF THE INVENTION

Hand dryers are typically installed in public washrooms as an alternative to paper towels.

There are three main types of hand dryer on the market: "warm-air" hand dryers, "high speed" hand dryers and "air-knife" hand dryers.

Warm air hand dryers are very well known. They are invariably low flow, low speed machines which rely on heating the air to promote an evaporative drying effect at the surface of the hand. Examples include the Model A Series of hand dryers manufactured and marketed by World Dryer Corporation. The heated airflow is typically discharged through a single nozzle and the drying action is a "hand-over-hand" action, requiring the user to rub the hands together under the nozzle with the aim of encouraging the evaporative drying effect.

High speed hand dryers, as the name suggests, use high speed airflow (>80 m/s) to provide a momentum-drying effect at the surface of the hands. Examples include the Xlerator® hand dryer manufactured and marketed by Excel Dryer Inc. Again the airflow is typically discharged through a single nozzle and the mode of use is somewhat similar to the "hand-over-hand" action of the warm air dryer, with the hands being held or cupped together underneath the nozzle to dry them. However, instead of being evaporated, the vast majority of the water on the surface of the hands is instead driven or blasted from the hands by the high-momentum airflow, with evaporation accounting for only a small proportion of water removal. The airflow tends not to be heated, though waste heat from the motor may in some cases be used to heat the airflow to a degree.

The third general type of hand dryer is the air-knife hand dryer, examples of which include the Dyson Airblade range of Hand Dryers manufactured by Dyson (UK) Limited and the Jet Towel range of hand dryers manufactured by Mitsubishi Electric Corporation These hand dryers use an air-knife—effectively a sheet or curtain of moving air—to remove the water from the user's hands. The mode of operation is analogous to the established use of air knives in industry to remove debris or liquid from the surface of a product (see e.g. EP2394123A1, which describes removal of debris from a glass sheet using air knives): the air-knife moves across the surface of the hand and, as it does so, wipes or scrapes the water from the surface of the hand.

In both the Dyson Airblade and the Mitsubishi Jet Towel, two opposing, stationary air-knives are used, one for each side of the user's hand. The hands are inserted between the air-knives and then withdrawn slowly to effect the required relative movement between the hands and the air knives.

In the Dyson arrangement—shown in FIG. 1—the air knives are discharged through narrow, continuous slots (only the rear slot a is visible in FIG. 1), each less than 1 mm wide. In the Mitsubishi machine—shown in FIG. 2—the air-knife is instead discharged through opposing rows of individual discharge apertures (only the rear row b is visible in FIG. 2): here, the individual jets combine to produce the air knife downstream of the discharge apertures. In each case, the air knife is discharged at high speed (>80 m/s) to provide for an efficient wiping action across the surface of the hand.

SUMMARY OF THE INVENTION

The present invention is concerned with air-knife hand dryers, specifically.

According to the present invention, there is provided a wall-mountable hand dryer of the type which uses an air-knife to wipe the water from a user's hand, the hand dryer being configured to have a maximum depth, front-to-back, of 150 mm or less when it is surface-mounted on—not recessed within—the wall, the air-knife being discharged downwardly through one or more discharge apertures on the dryer, the discharge apertures being configured so that the air-knife is discharged in front of the wall or a rear part of the dryer at a forward angle towards the user, the angle of the air-knife being such that the air-knife projects to a distance of at least 75 mm in front of the wall or, as the case may be, in front of the rear part of the dryer.

The hand dryer has the advantage that it is a low profile design. The maximum depth of 150 mm when it is surface mounted on the wall is significantly less than the Dyson Airblade hand dryer shown in FIG. 1 (depth front-to-back 250 mm approx) or the Mitsubishi Jet Towel hand dryer shown in FIG. 2 (depth front-to-back 220 mm approx). In particular, the maximum depth of the dryer may be 4 inches (101.6 mm) or less, allowing surface-mounting of the hand dryer in compliance with the Americans with Disabilities Act 1990 (ADA). This avoids the inconvenience and expense of having to recess the hand dryer into the wall in order to comply with the ADA: particularly advantageous when retro-fitting the hand dryer.

Despite the significant reduction in profile depth, the dryer nevertheless provides an effective air-knife drying action. The user dries the hands palm-open—moving the hands lengthwise front-to-back underneath the discharge aperture(s). The air knife is directed downwardly onto the hands and, as the hand is moved relative to the discharge aperture(s), the air-knife mechanically wipes the water from the surface user's hands to dry them.

Because the drying action is a front-to-back action, the user can increase the effective depth of the dryer by pitching the hands down. The most suitable pitch angle will vary according to the effective depth required by the user—users with larger hands will tend to pitch their hands at a steeper angle. By ensuring that the air-knife projects in front of the wall—or the rear part of the dryer—by at least 75 mm, the pitch angle is maintained within comfortable limits for most users. Consequently, the invention provides a shallow, low profile hand dryer which nevertheless offers an effective air knife drying action.

The discharge aperture(s) may be arranged to span the width of a user's hand, so that the air-knife provides a wiping action the full width of the user's hand. A lateral span of at least 80 mm is considered sufficient in most cases. If it is intended to dry both hands at the same time, then the discharge aperture(s) may be arranged to span the width of both hands side-by-side underneath the discharge apertures(s). A lateral span of at least 200 mm is considered preferable in this case, though again this is not essential—a shorter span may be suitable for certain countries, for example The exit airspeed through the discharge aperture(s) is preferably in excess of 80 m/s to ensure that the air knife has an effective wiping action at the surface of the hands. A particularly effective wiping action can be obtained at airspeeds in excess of 150 m/s. The exit air speed is determined in accordance with general air knife principles by the discharge area and the pressure behind the discharge aperture(s). So, for example, increasing the discharge area will reduce the exit air speed at a given pressure. Increasing the pressure for a given discharge area will increase the exit air speed.

The discharge aperture(s) may take the form of air holes arranged in a row or, alternatively, an elongate air slot. For example a single elongate air slot or row of air holes may be provided to discharge a single air-knife for drying the hands one after another; a pair of such slots or rows of holes may be provided for generating two separate air-knives which dry the hands simultaneously, or a single elongate slot or row of holes may be provided for generating a single air knife which is sufficiently long to dry the hands simultaneously side-by-side.

The slot, or air holes, may be less than 2 mm wide, intended to provide a laminar, well-defined air knife with minimal wind shear. In one embodiment, the length of the slot—or length of the row of air holes—is at least 80 mm.

At least two discharge apertures may be provided, the discharge apertures being configured to discharge two separate air knives: one for each hand. In this case, the discharge apertures may be arranged to direct the air-knives either side of the user in use, to reduce blow-back onto the user. Thus, the air-knives may be discharged in diverging directions: a first direction extending outwardly to the left of the dryer, and a second direction extending outwardly to the right of the dryer. The angle between the two directions is preferably in excess of 100 degrees. A range of 100-120 degrees is considered preferable.

The discharge aperture(s) may be arranged in a V-shape configuration, viewed from the front of the dryer. This allows a user to bank his (or her) hands at a comfortable angle in use.

The discharge aperture(s) may be spaced 75 mm or more from the wall or, as the case may be, the rear part of the dryer, though this is not essential.

The dryer may have a projecting part which projects either from the wall or from a rear part of the dryer in use, the discharge aperture(s) being provided on the underside of the projecting part. This is a convenient arrangement for directing the air knife downwardly at an angle in accordance with the invention.

The discharge aperture(s) may face a lower part of the dryer, with the discharge aperture(s) being spaced at least 120 mm from said lower part of the dryer. By spacing the lower part of the dryer at least 120 mm from the discharge aperture(s), the majority of users are able to pitch their hands down sufficiently without touching the lower part of the dryer.

In one embodiment, the discharge apertures are provided on the underside of an external casing of the hand dryer so that they face the floor, rather than a lower part of the hand dryer. This arrangement has the benefit of a large clearance underneath the discharge aperture for pitching the hands in use.

BRIEF DESCRIPTION OF THE DRAWINGS

Embodiments of the invention will now be described with reference to the accompanying drawings, in which.

DETAILED DESCRIPTION OF THE INVENTION

Figure 1:
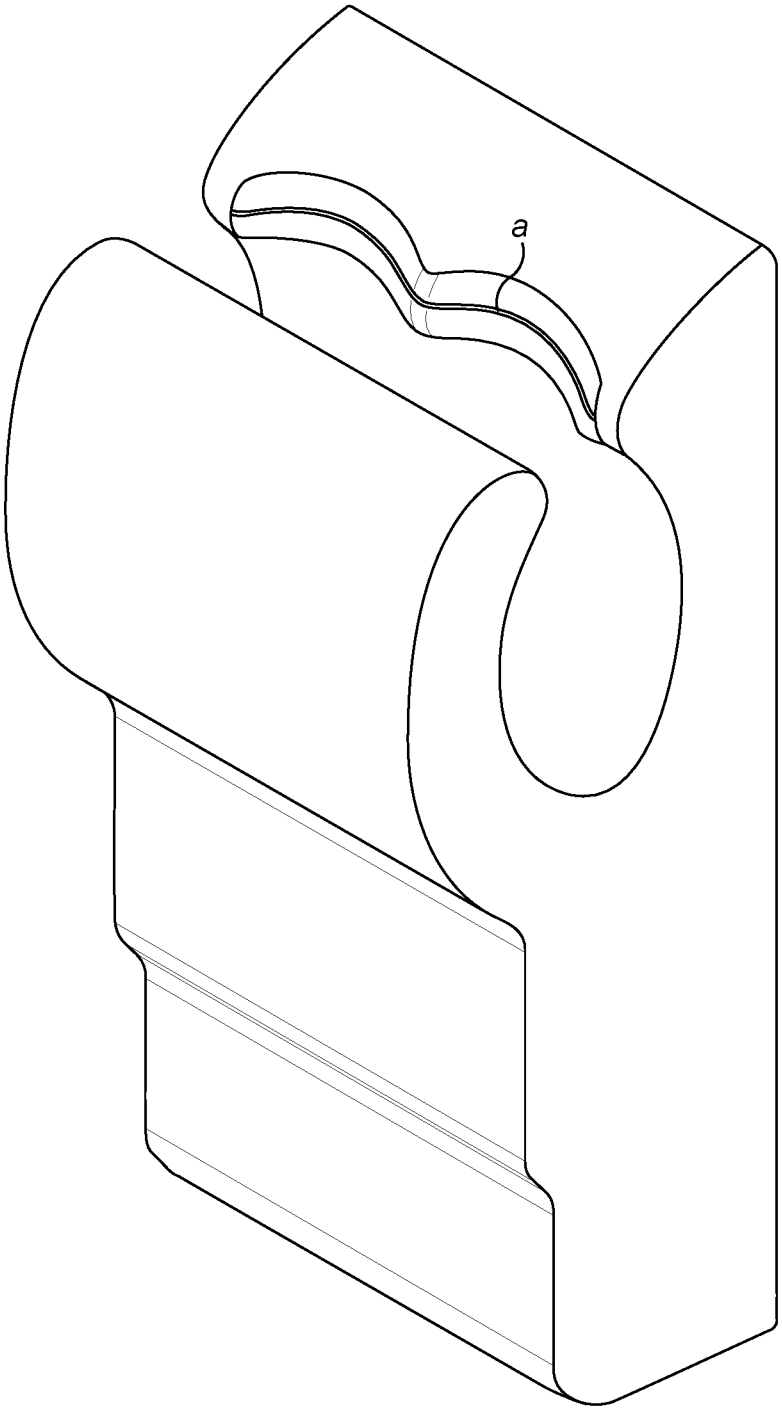
FIG. 1 Prior Art
FIGS. 1 and 2 are schematic perspective views of conventional air-knife hand dryers.

For simplicity, unless otherwise stated corresponding features have been given corresponding reference numerals in the following description.

Figure 3:
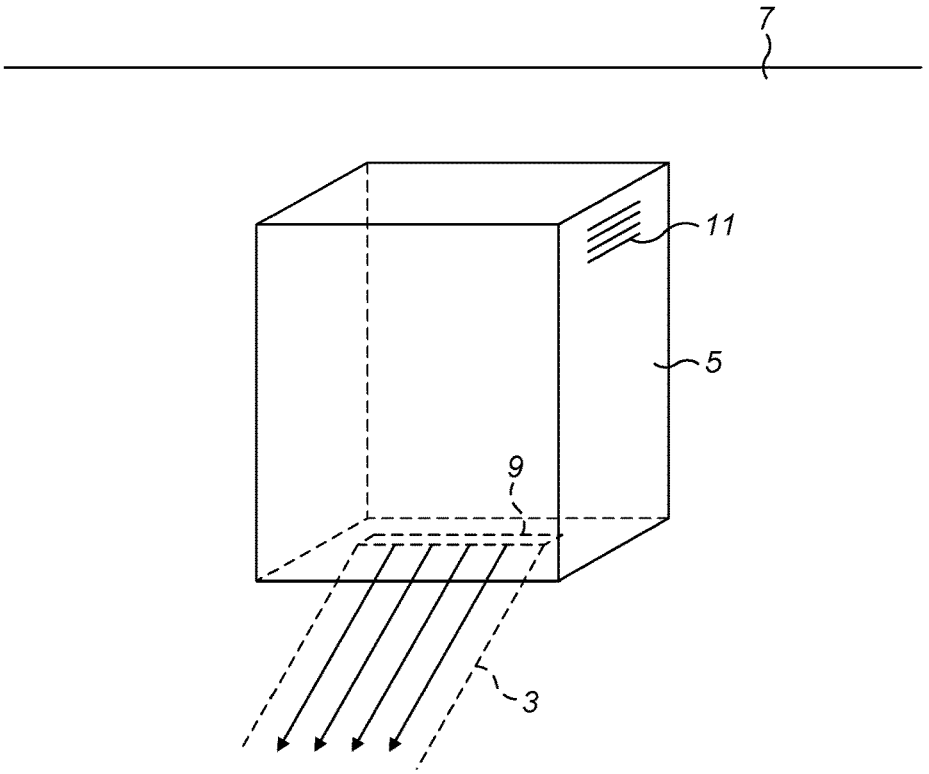
FIG. 3 is a schematic perspective view of a wall-mountable hand dryer in accordance with a first embodiment of the present invention.
Figure 4:
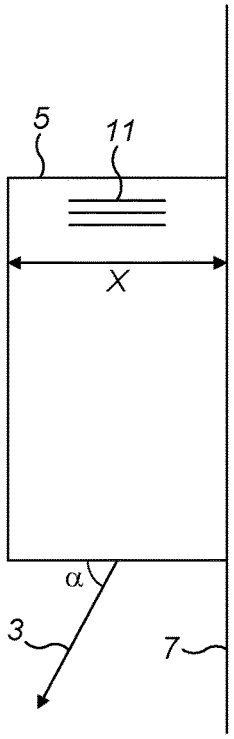
FIG. 4 is a side view corresponding to FIG. 3.

FIGS. 3 and 4 illustrate a wall-mountable hand dryer 1 which works by using an air knife 3—a curtain or sheet of moving air—to wipe the water from a user's hands.

The hand dryer 1 is illustrated in its normal wall-mounted orientation.

The hand dryer 1 comprises an external box-like casing 5 which projects a distance X from the wall 7 (FIG. 4). The external casing 5 is configured so that X is 4 inches (101.6 mm). Thus, the dryer is "ADA-compliant", meaning that it complies with the Americans with Disabilities Act 1990:

"4.4.1* General. Objects projecting from walls (for example, telephones) with their leading edges between 27 in and 80 in (685 mm and 2030 mm) above the finished floor shall protrude no more than 4 in (100 mm) into walks, halls, corridors, passageways, or aisles . . . "

Source: ADA Accesibility Guidelines for Buildings and Facilities (ADAAG)

The air-knife 3 is discharged downwardly at an angle $\alpha$, through a discharge aperture 9 on the underside of the casing 5. The air knife 3 thus projects in front of the wall 7.

The discharge aperture 9 is in the form of an elongate discharge slot, which extends laterally across the dryer 1 (in this case generally parallel with the wall 7). The front and back walls of the discharge slot 9 are angled accordingly so that the air knife 3 is discharged at the required downward angle $\alpha$.

The user dries the hands palm-open, moving the hand lengthwise front-to-back underneath the discharge slot 9.

Figure 2:
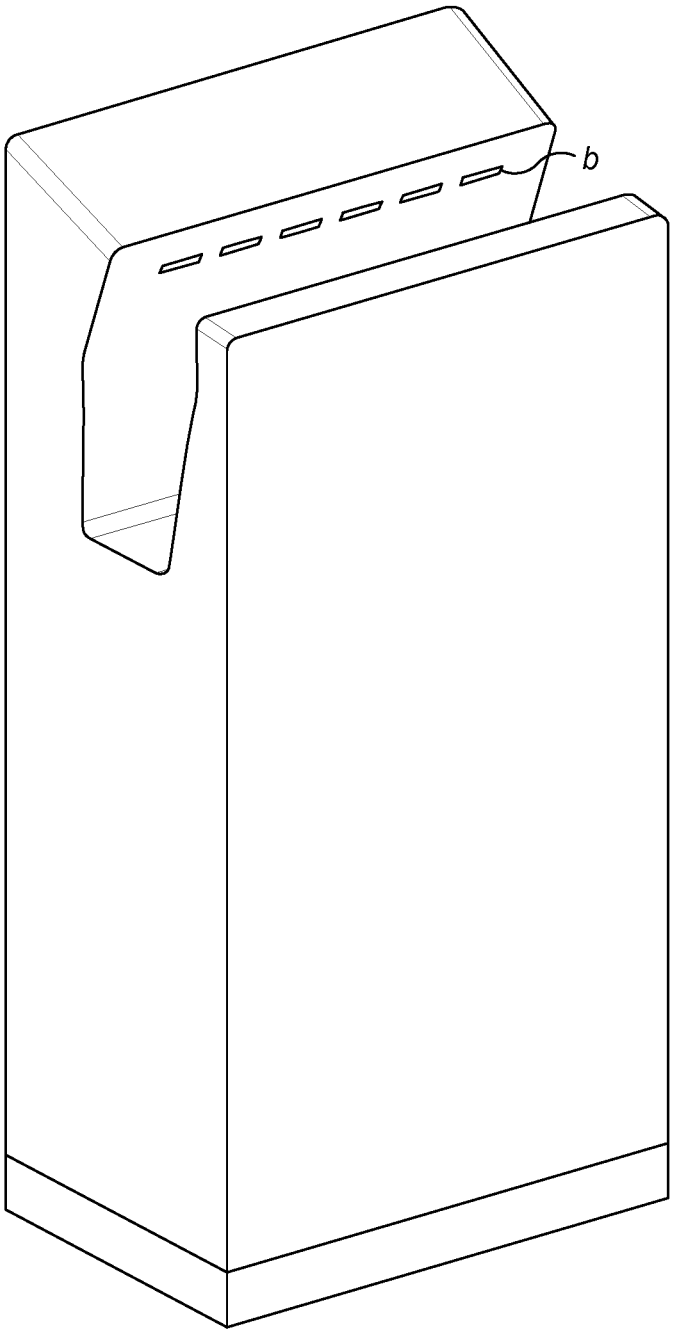
FIG. 2 Prior Art
Figure 5:
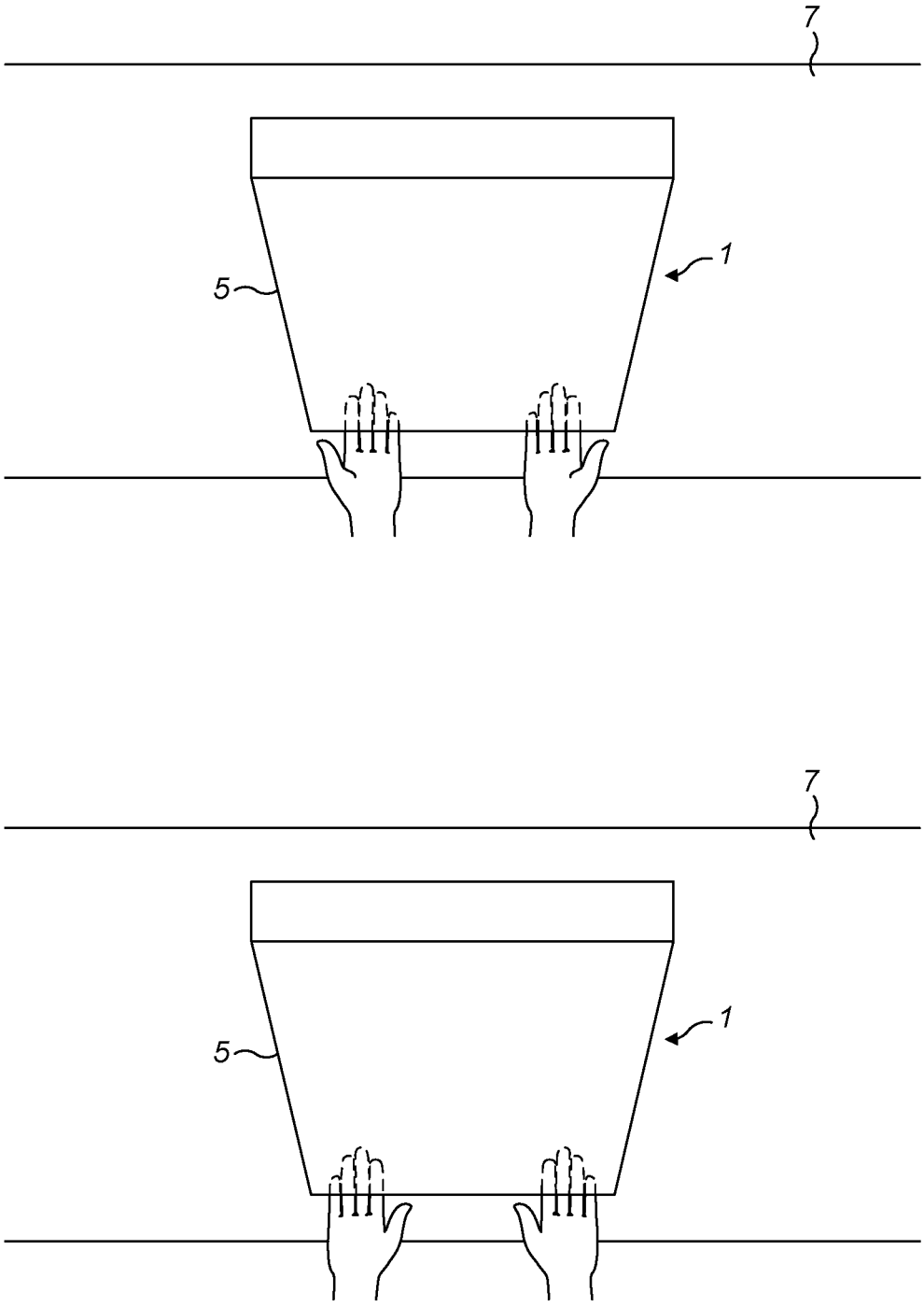
FIG. 5 is a schematic view looking down on the hand dryer shown in FIG. 3, illustrating the mode of use of the hand dryer.

The hands are dried one-side at a time (cf. the conventional two-sided arrangements illustrated in FIGS. 1 and 2): one or more passes is made with the palms facing upwards, and then the hands are turned over and one or more passes is made with the back s of the hands facing upwards. This is illustrated in FIG. 5, looking down on the dryer 1 from above.

The discharge slot 9 is 250 mm long—intended to span both hands held side-by-side under the discharge slot. A shorter discharge slot may alternatively be used—say, 120 mm in length—to dry first one hand and then the other in turn.

As the hands are moved relative to the discharge slot 9, the air-knife 3 mechanically wipes the water from the surface of the user's hands to dry them.

Figure 6:
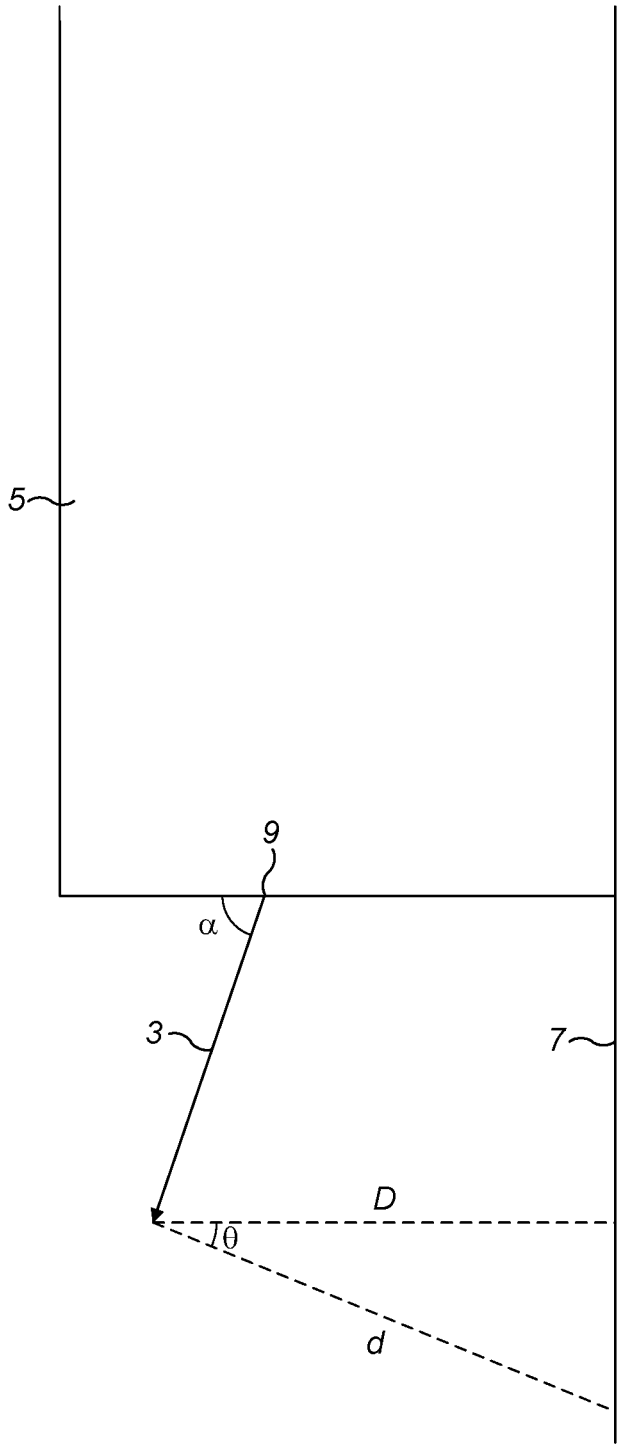
FIG. 6 is a side view of the bottom part of a wall-mountable hand dryer.

The shallow depth of the dryer 1 on the wall 7 means that a typical user's fingertips will tend to contact the wall 7 if the hands are held horizontal underneath the dryer 1. However, the front-to-back drying action means that the user can avoid this by pitching the hand down at an angle θ as it passes underneath the discharge slot, increasing the effective depth of the dryer (FIG. 6).

If the air-knife projects out to a distance D in front of the wall, then the effective depth, d, is given by D=dcos θ. To provide for a comfortable pitch angle θ in most cases, the downward angle α of the air knife 3 is set so that D is 75 mm in accordance with the invention, meaning that the air knife projects (at some point) 75 mm in front of the wall 7.

The precise pitch angle θ will vary from user to user for a given value of D. A user with relatively large hands, may prefer an effective depth d of, say, 150 mm—equating to a pitch angle θ of 60 degrees if D=75 mm—whereas a user with small hands may only require an effective depth d of 120 mm—equating to a pitch angle θ of approximately 50 degrees if D=75 mm.

In the arrangement in FIGS. 3 and 4, the discharge slot 9 is spaced 50 mm in front of the wall 7. A shallower angle α may be used to provide a given value for D, by moving the discharge apertures further towards the front of the dryer. Positioning the discharge apertures a long a front edge of the dryer will minimize the angle α. Nevertheless, for a given position of the discharge apertures, discharging the air-knife forwards at a downward angle will maximize the distance D.

The discharge slot 9 is fed via a ducted motor-driven fan housed inside the external casing 5 of the dryer 1, which fan draws air in through the intakes 11 on the side of the casing 5 and forces this air out through the discharge slot 9 to generate the air-knife 3.

The discharge slot 9 is less than 2 mm in width. The motor-driven fan is configured to provide a an exit airspeed through the discharge slot 9 in excess of 80 m/s. This is intended to provide a well-defined, high speed, laminar air-knife which exhibits low wind shear. A particularly effective wiping action can be obtained at airspeeds in excess of 150 m/s.

Alternatively, a source of compressed air may be used to feed the discharge slot 9 via a plenum chamber behind the slot 9.

The discharge slot 9 is formed directly in the wall of the casing 5. Though not essential, this provides for easy-cleaning of the casing 5, and allows the casing 5 itself to be used as a duct or plenum for feeding the discharge slot 9.

Preferably, the slot 9 is machined into the wall of the casing 5—this provides good dimensional tolerance—but if the casing 5 is moulded then the slot 9 itself could be moulded as part of the casing 5.

Figure 7:
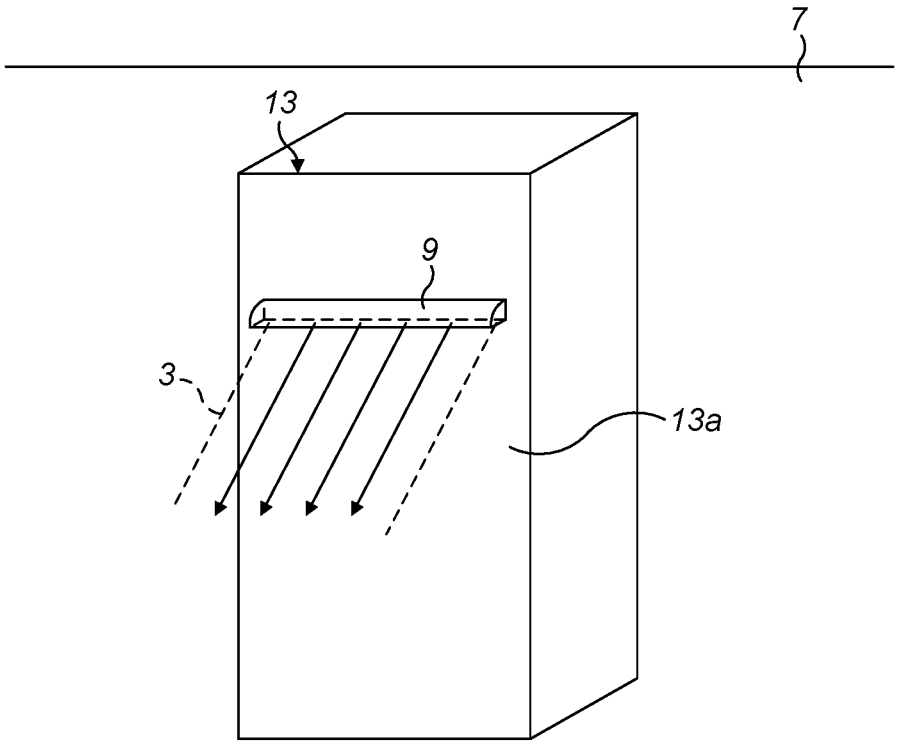
FIG. 7 is a schematic perspective of a wall mountable hand dryer in accordance with a second embodiment of the present invention.
Figure 8:
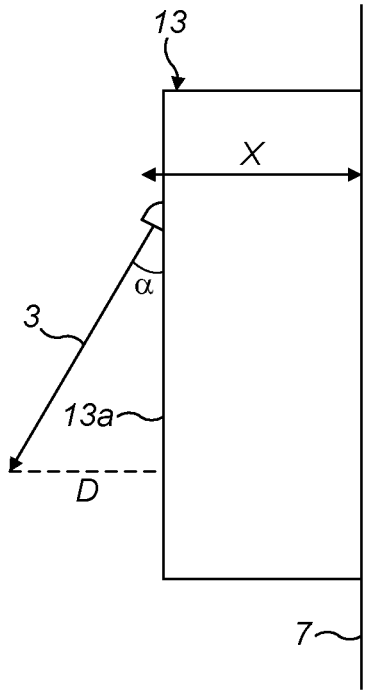
FIG. 8 is a side view corresponding to FIG. 7.
Figure 9:
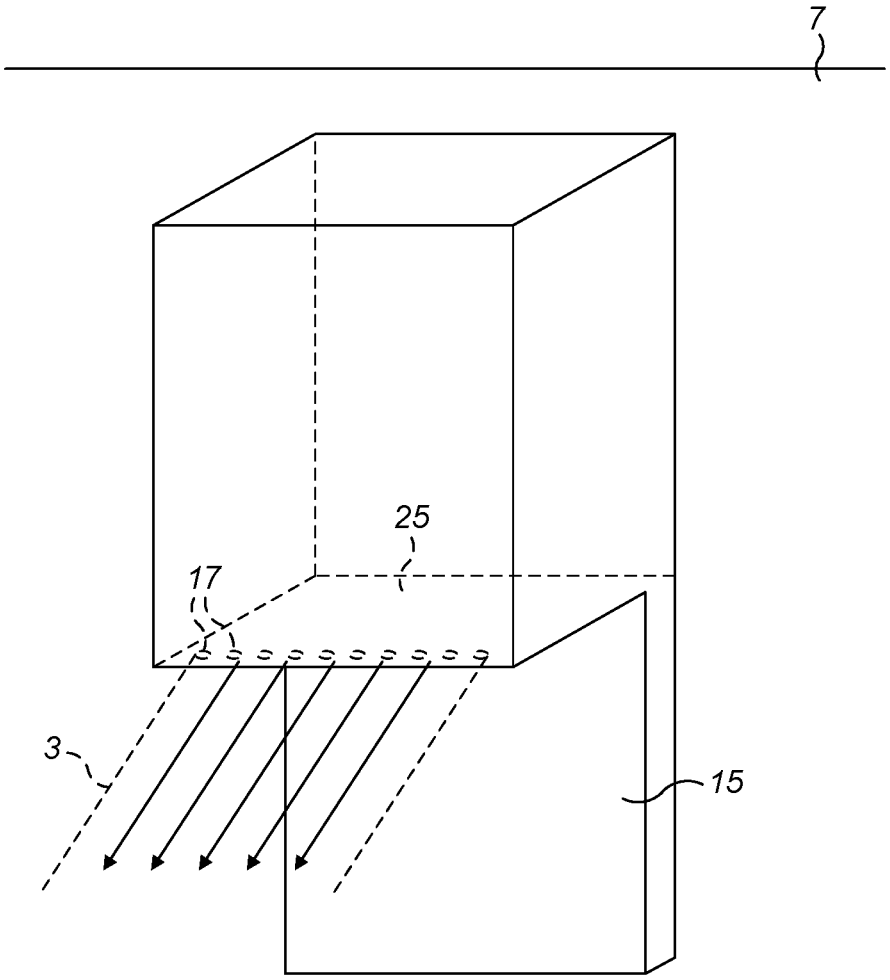
FIG. 9 is a perspective view of a wall-mountable hand dryer in accordance with a third embodiment of the present invention.

FIG. 7 shows an alternative arrangement in which the air-knife 3 projects in front of a rear part of the hand dryer, rather than in front of the wall 7. The rear part—being a rear part in the sense that it is behind the air knife 3—is in this case the front face 13*a* of an external casing 13 of the hand dryer. FIG. 9 shows a different arrangement in which the rear part of the hand dryer is a back-plate 15 and the discharge slot is provided on the underside of a projecting part 25 of the dryer which projects from the back-plate 15 (cf. the arrangement in FIG. 3 where the discharge slot is likewise provided on a projecting part of the dryer—the external casing—but which projects instead from the wall 7). In each case, the respective downward angle α is such that the air knife 3 projects a distance of at least 75 mm in front of the rear part of the dryer (see FIG. 8, where D=75 mm).

The discharge aperture does not need to be an elongate slot. In the arrangement of FIG. 9, for example, the air knife 3 is discharged through a row of closely spaced discharge apertures in the form of round holes 17.

Figure 10:
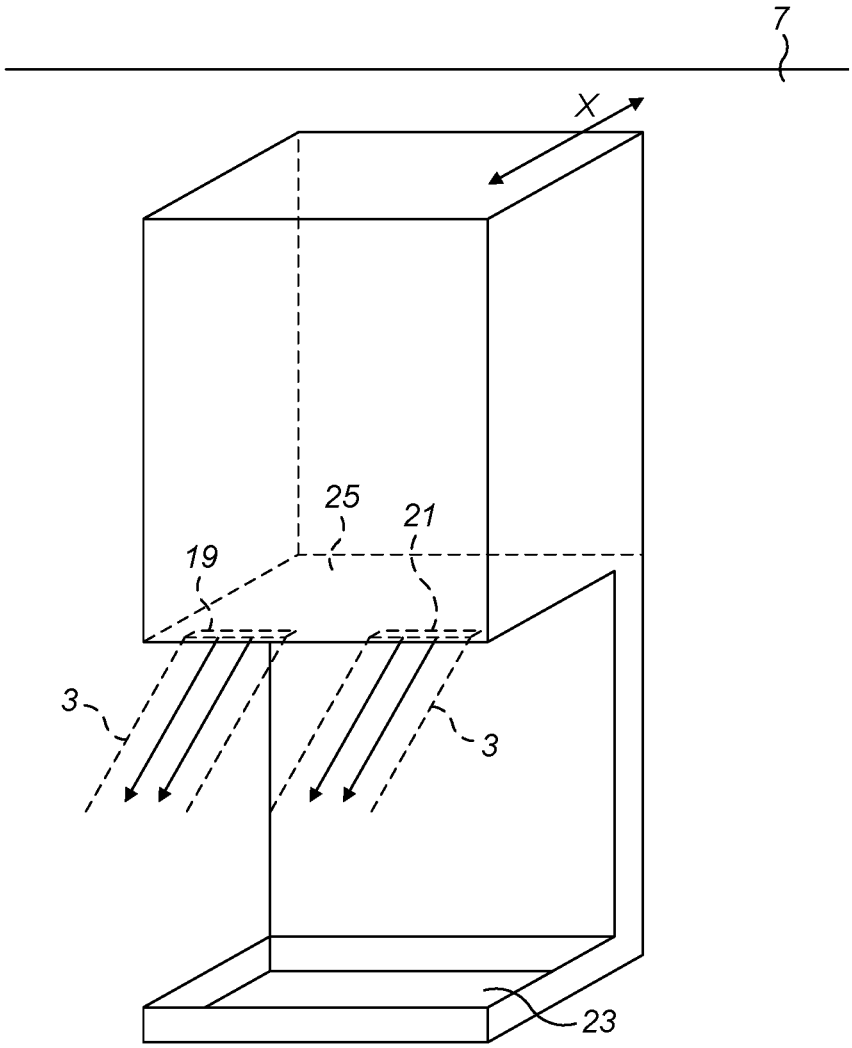
FIG. 10 is a perspective view of a wall-mountable hand dryer in accordance with a fourth embodiment of the present invention.
Figure 11:
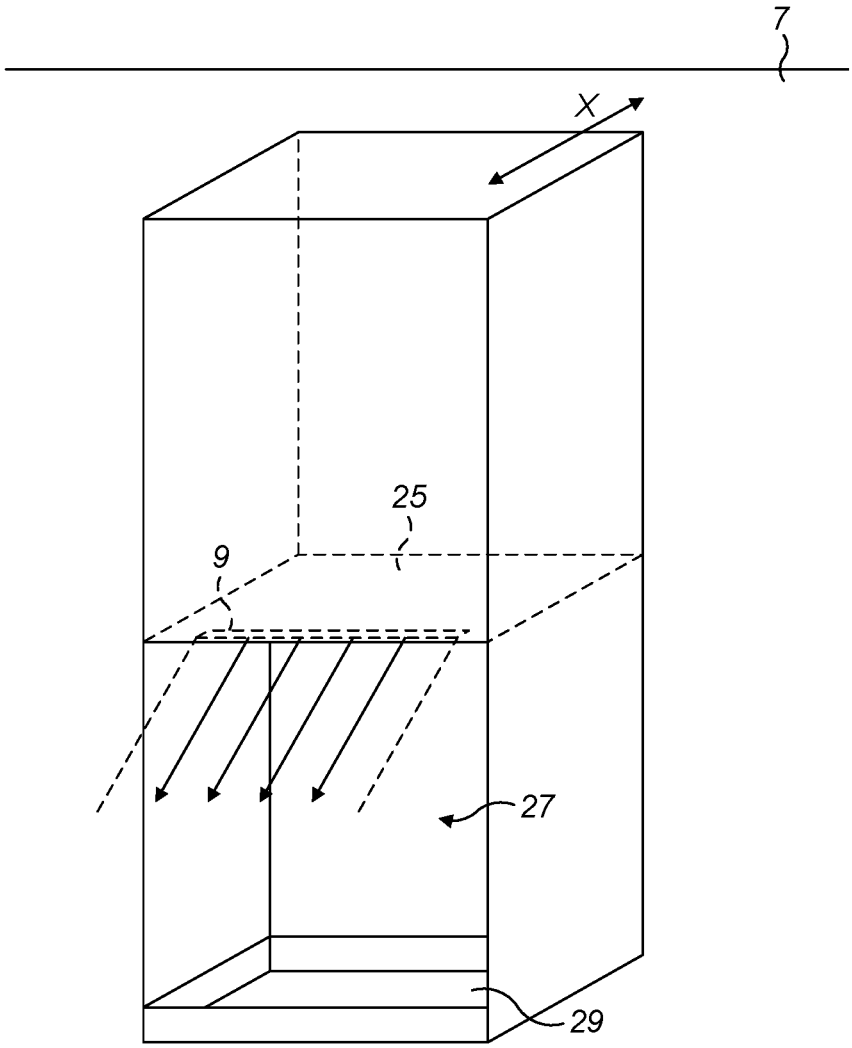
FIG. 11 is a perspective view of a wall-mountable hand dryer in accordance with a fifth embodiment of the present invention.

FIG. 10 shows an arrangement in which the discharge apertures are arranged facing a lower part of the dryer, rather than facing the floor. Here, the lower part of the dryer is a drip tray 23 for collecting waste water. The dryer is open to the sides in between the projecting part 25 and the drip tray 23, but this is not essential: side walls may be provided to define an enclosed drying cavity 27, as shown in FIG. 11. In this case, the projecting part 25 defines the roof of the cavity 27, and the discharge slot 9 faces the base 29 of the drying cavity 27.

In the arrangement in FIG. 10, the discharge apertures take the form of two separate discharge slots 19, 21—one for each hand—rather than a single "double-span" discharge slot.

In both of the arrangements of FIG. 9 and FIG. 10, the discharge slots 9, 19, 21 are provided along a front lower edge of the projecting part 25, so that they are spaced the maximum depth X from the wall, which in this case is 4 inches (101.6 mm) for ADA compliance. In this arrangement, an effective depth of 150 mm equates to a pitch angle θ of 48 degrees and an effective depth of 120 mm equates to a pitch angle θ of 34 degrees.

Figure 12:
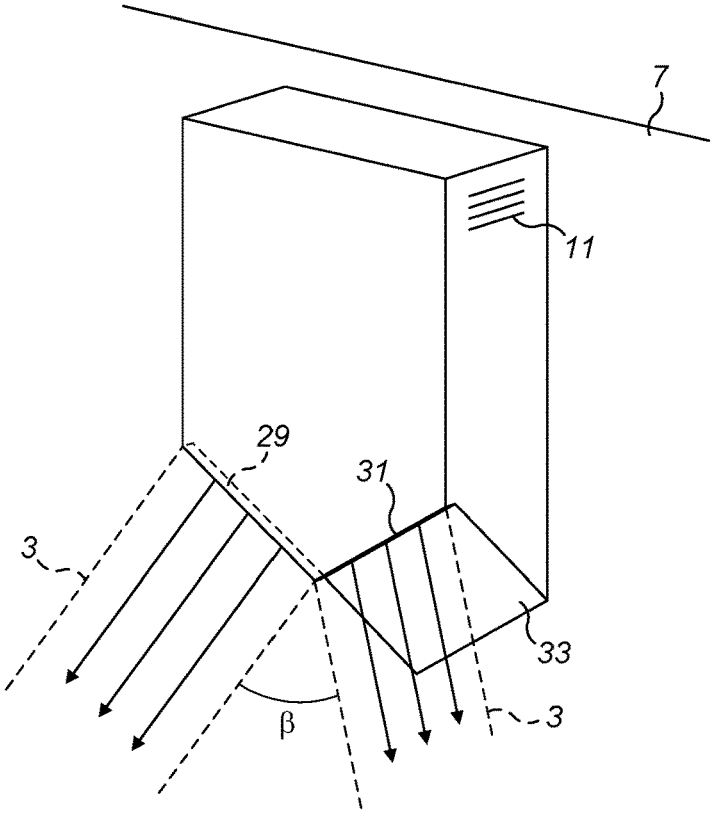
FIG. 12 is a perspective view of a wall-mountable hand dryer in accordance with a sixth embodiment of the present invention.
Figure 13:
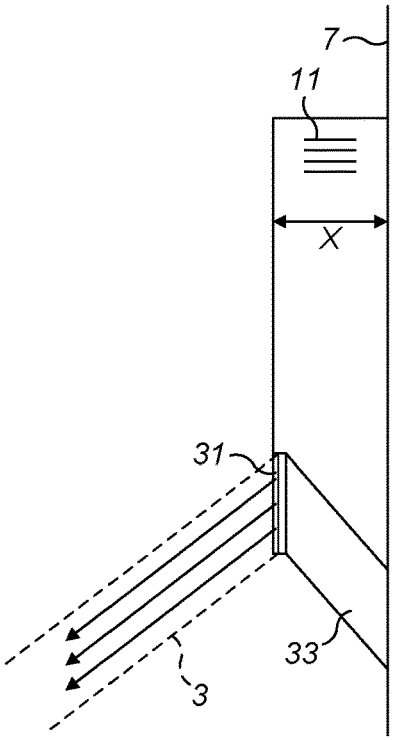
FIG. 13 is a side view corresponding to FIG. 12.

FIGS. 11 and 12 illustrate an arrangement in which the dryer is provided with discharge slots 29, 31 which are arranged in a V-configuration (viewed from the front of the dryer). This allows a user to bank the hands in use, making the drying action more comfortable for the user.

The discharge slots 29, 31 are provided along the front lower edge of the hand dryer, which edge is V-shaped to provide the required V-configuration for the slots 29, 31. The hand dryer has a maximum depth X of 4 inches (101.6 mm) when it is surface mounted on the wall.

The discharge slots 29, 31 are arranged so that the respective air knives diverge at an angle β. This helps direct the air knives either side of the user (who will be standing directly in front of the dryer in normal use). A preferred range for β is 100-120 degrees.

A guide ramp 33 is additionally provided behind the slots 29, 31*s* in this arrangement. This is not essential, but provides the benefit that it encourages a user to pitch the hands downwards underneath the discharge aperture(s) in use.

ADA compliance is not an essential part of the invention. The depth X of the dryer may be up to 150 mm when it is surface mounted on the wall: this is still a significantly shallower profile than the conventional air-knife hand dryers illustrated in FIGS. 1 and 2.

The invention claimed is:

1. A wall-mountable air-knife hand dryer which uses an air-knife to wipe water from a user's hand, an external casing of the hand dryer being configured to have a maximum depth, front-to-back, when it is surface-mounted on—not recessed within—a wall, the air-knife being discharged downwardly through at least two discharge apertures on the casing, the at least two discharge apertures being configured to discharge at least two separate air-knives, each air-knife being discharged in front of the wall or a rear part of the dryer forwards away from the wall at a downward angle, the downward angle of the air-knife being such that the air-knife projects to a distance in front of the wall or in front of the rear part of the dryer, wherein the discharge apertures extend at least vertically away from a vertex thereby forming a V-shape configuration and, in use, the discharge apertures are configured to discharge the air-knives in diverging directions: a first direction extending outwardly to the left of the dryer away from the wall, and a second direction extending outwardly to the right of the dryer away from the wall.

2. The hand dryer of claim 1, with the discharge apertures being spaced a minimum of 75mm from the wall or the rear part of the dryer.

3. The hand dryer of claim 1, wherein each air-knife is discharged through a single aperture in a form of an elongate slot.

4. The hand dryer of claim 3, wherein the dryer comprises two such slots or rows of air holes for discharging two respective, separate air knives: one air knife for each hand.

* * * * *